US005421123A

United States Patent [19]

Sakate et al.

[11] Patent Number: 5,421,123

[45] Date of Patent: Jun. 6, 1995

[54] VEGETATION MAT

[75] Inventors: Michihei Sakate; Tomofumi Matsumoto; Jungi Katayama; Nobumasa Mitunaga; Shunta Tada; Kaname Hori; Hiroyuki Kambe; Kiwamu Iizuka, all of Tsuyama, Japan

[73] Assignee: Nisshoku Corporation, Okayama, Japan

[21] Appl. No.: 174,805

[22] Filed: Dec. 29, 1993

[51] Int. Cl.[6] ..... A01G 7/00; A01C 1/04

[52] U.S. Cl. ..... 47/56; 405/258; 47/9

[58] Field of Search ..... 47/56; 405/15, 258, 405/19

[56] References Cited

U.S. PATENT DOCUMENTS

| | | | |
|---|---|---|---|
| 2,876,588 | 3/1959 | Tietz | 47/56 |
| 3,362,106 | 1/1968 | Goldring | 47/56 |
| 4,635,576 | 1/1987 | Bowers | 112/403 |

FOREIGN PATENT DOCUMENTS

| | | | |
|---|---|---|---|
| 434900 | 7/1991 | European Pat. Off. | 47/56 |
| 2219448 | 10/1973 | Germany . | |
| 2444436 | 3/1976 | Germany | 47/56 |
| 3631716 | 3/1988 | Germany . | |
| 4113215 | 10/1992 | Germany . | |
| 149506 | 12/1978 | Japan | 47/56 |
| 1320909 | 12/1989 | Japan | 47/56 |

OTHER PUBLICATIONS

Abstract of Japanese 57-133926, Ayada, Turf Planting Work, Aug. 18, 1982.

Abstract of Japanese 4357212, Sakate et al., Vegetation Foundation for Greening and Vegetation Bag and Grass Spreading Body Utilizing it on, Oct. 12, 1992.

*Primary Examiner*—Henry E. Raduazo

*Attorney, Agent, or Firm*—Wenderoth, Lind & Ponack

[57] ABSTRACT

The laying of a vegetation mat in close contact with a clad surface is achieved. The vegetation mat has a net, which prevents freezing or flow-away of vegetation material without the need for stretching a separate net. The mat comprises a layer of vegetation material selected from the group consisting of soil improvement material, fertilizer, organic material, vegetation seeds and combinations thereof, a front and back sheet, which are capable of being at least partly decomposed and are coupled together to wrap the vegetation material. A net having a mesh size permitting the budding and growth of the vegetation seeds, is provided on the front surface of the front sheet.

11 Claims, 4 Drawing Sheets

VEGETATION MAT

BACKGROUND OF THE INVENTION

1. Field of the Invention

This invention relates to vegetation mats used for a process of growing plants on the clad surfaces of hills or river banks or other clad surfaces formed by road construction and land formation.

2. Description of the Prior Art

The clad surfaces noted above are usually made green by growing plants in order to protect them and maintain wanted scenery.

Such green clad surfaces are usually produced by using vegetation mats. Such vegetation mats are formed by using a growth base formed by mixing a soil improvement material, an organic fertilizer and a fertilization material, providing a jute fiber felt containing fertilizer on the lower clad surface of the growth base, wrapping the base and felt with a seed-containing cloth, which includes seeds provided between woven jute fiber cloth and cotton body, and sewing together the three components such that ridges are formed at a predetermined interval in the width direction (see, for instance, Japanese Utility Model Publication No. H3-20348).

In this prior art vegetation mat, however, the jute fiber felt that is held in contact with the clad surface is comparatively hard. Therefore, the vegetation mat is inferior in its familiarity with the clad surface, and it is liable that its back surface is locally spaced apart from the clad surface. Besides, the jute fiber felt takes a long time for its corrosion although it may contain water, that is, the soil improvement material, organic fertilizer and fertilization material do not easily fall onto the clad surface. Consequently, a gap is produced between the vegetation mat and clad surface, making it difficult for the seeds to root although they may bud, and therefore many of them will decay.

Further, where sole vegetation mats are used for making green surfaces, with corrosion and decomposition of the seed-containing cloth in a defective state of budding and growth of the seeds, the growth base will be frozen or flown away with rainfall. To cope with this, the vegetation mats provided on the clad surface are covered with nets, or each vegetation mat is provided in a state that it is accommodated in a bag-like mat holder section provided in it. However, the operation of providing such nets is complicated and cumbersome and requires a great deal of man-hours, thus leading to high process cost.

SUMMARY OF THE INVENTION

The present invention has been intended in the light of the above circumstances, and its object is to provide a vegetation mat, which has satisfactory familiarity with the clad surface, permits satisfactory budding and growth of vegetation seeds and is excellent in view of the processibility and cost.

To attain the above object of the invention, the vegetation mat according to the invention features that it comprises a vegetation material, which includes at least one member of the group consisting of soil improvement material, fertilizer and organic material and vegetation seeds, a front and a back sheet, which have a character of being at least partly decomposed and are coupled together such as to wrap the vegetation material, and a net provided on the surface part of the front sheet and has such meshes as to permit the budding and growth of the vegetation seeds.

In the vegetation mat having the above structure according to the invention, both the front and back surfaces are constituted by thin sheets, and the mat as a whole is richly flexible. The vegetation mat is thus satisfactorily familiar with the clad surface and can be held in close contact therewith with suppression of the locally spaced-apart state.

Further, since the sheets have a character of being at least partly decomposed, the decomposition of the back side sheet facilitates partial or entire close contact of the vegetation material with the clad surface and has an effect of suppressing the formation of a gap between the vegetation mat and the clad surface. Further, since the mat has a surface net, when the front side sheet is partly or entirely decomposed, the freezing or flow-away of the vegetation material can be effectively prevented without need of any operation of providing a separate net.

DETAILED DESCRIPTION OF THE PREFERRED EMBODIMENT

Figure 1:
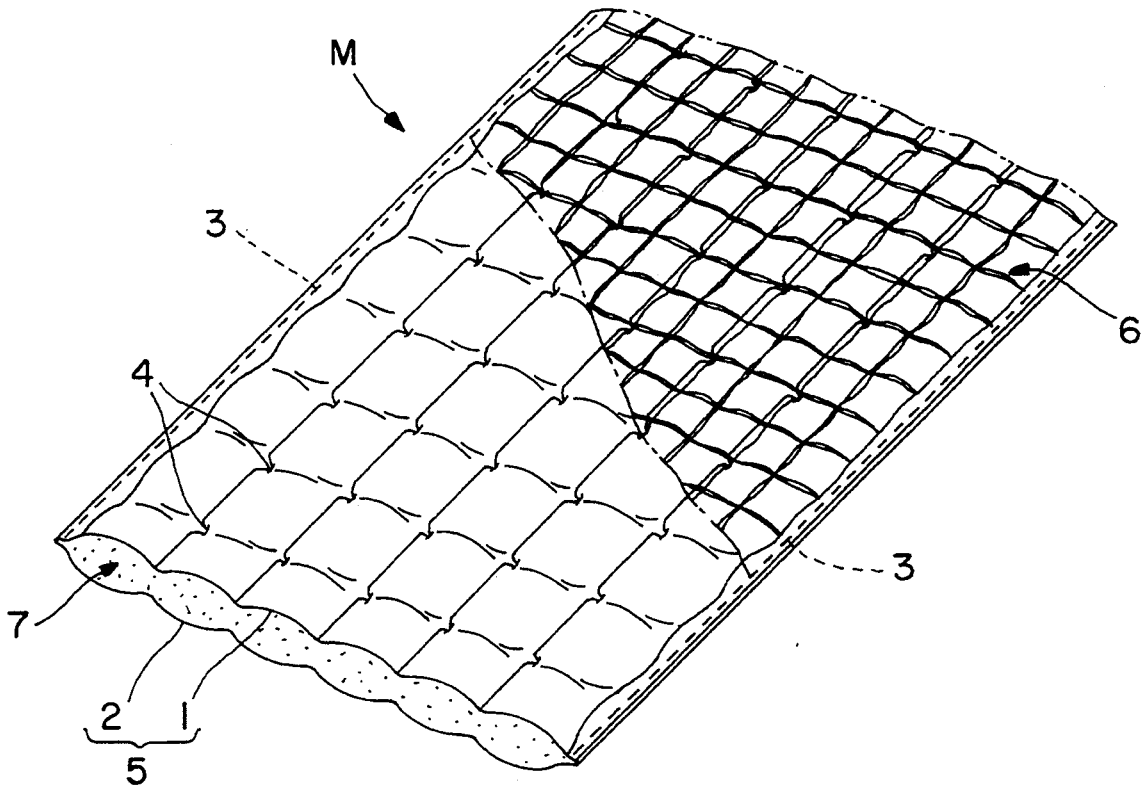
FIG. 1 is a perspective view, partly broken away, showing an embodiment of the vegetation mat according to the invention.

Now, a preferred embodiment of the vegetation mat according to the invention will be described with reference to FIG. 1. The illustrated vegetation mat, which is generally designated at M, comprises a front sheet 1 having a character of being at least partly decomposed, and a back sheet 2 having a water-soluble character. The two sheets 1 and 2 are sewed together, as shown at 3, along their edges at a fine interval. In addition, they are sewed together, as shown at 4, at a coarse interval in the length direction and at a predetermined interval in the width direction. Thus, the front and back sheets 1 and 2 form a bag body 5 having a restricted interval between them. A net 6 having a mesh size permitting the budding and growth of vegetation seeds, is provided on the front part of the bag body 5. The bag body 5 is filled with a seed-containing vegetation material 7.

The sheets 1 and 2 are sewed together by using a large size sewing machine. The sewing yarn is suitably made of jute cotton or Rayon.

The vegetation material 7 is formed by mixing vegetation seeds of unicotyledoneous or dicotyledoneous plants with one or more members of the group consisting of general chemical fertilizer, soil improvement material, bark fertilizer, organic material such as peat moss and inorganic material such as vermiculite or pearlite. With this material, the bag body 5 is filled to produce the vegetation mat M. If necessary, a glue material, such as poval, base soiler, vinyl acetate type powder emulsion, may be added, and the vegetation material 7 may be shaped by such means as a press into the form of a plate, and the front and back sheets 1 and 2 may be sewed together such as to wrap such plate. As a further alternative, the vegetation material 7 may be accommodated in the form of bars in the bag body 5. Thus, the vegetation mat according to the invention may have various forms.

In the above example, the vegetation material in the form of a plate is disposed in a sandwiched fashion between the front and back sheets, and the edges thereof are sewed together. In addition, in the plane of the three components, i.e., the two sheets and the vegetation material, they are sewed together in the width direction at a predetermined interval and also in the length direction. A vegetation mat having a predetermined thickness thus can be obtained, in which deviation of the vegetation material can be prevented.

Figure 2:
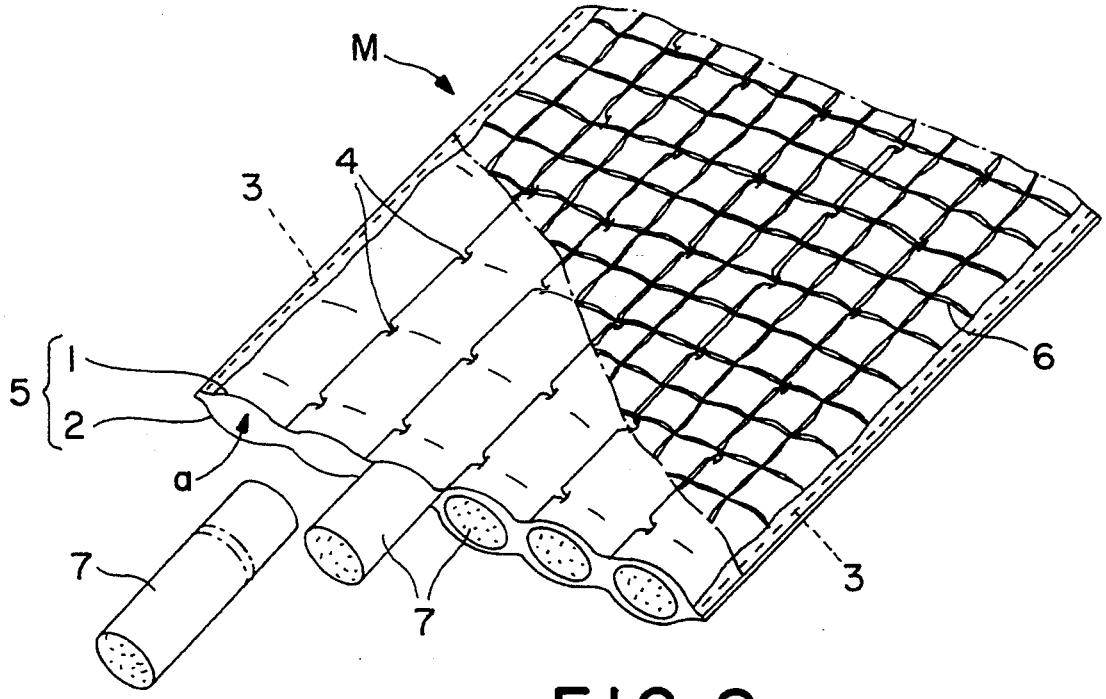
FIG. 2 is a perspective view, partly broken away, showing a different embodiment of the vegetation mat.

FIG. 2 shows a different embodiment of the vegetation mat M. In this instance, a front and a back sheet 1 and 2 have their edges sewed together as shown at 3 except for the edges at one end in the length direction, and also they are sewed together in the width direction at a predetermined interval to form accommodating sections (a) for accommodating vegetation material 7. Vegetation material 7 in the form of powder or rods are accommodated in the accommodating sections (a), and the edges of the sheets 1 and 2 at one end in the length direction as noted above, remaining without being sewed, are sewed together.

The net 6 which is provided on the front surface of the bag body 5 serves to prevent the freezing and flow-away of the vegetation material 7 with the front sheet 1 in a partially dissolved state in cooperation with the non-dissolved portion of the front sheet 1. It uses a plant material, such as jute yarn, cotton yarn, paper tape, Rayon type yarn, etc., and is produced by plan weaving, braid weaving or Rassel weaving.

Figure 3:
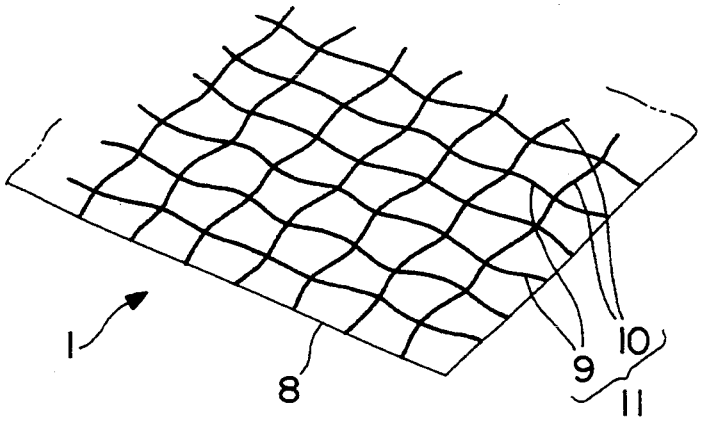
FIG. 3 is a schematic fragmentary perspective view, to an enlarged scale, showing a front sheet.

The front sheet 1, as shown in FIG. 3, comprises a water-soluble sheet-like member 8 and a mosquito net material 11 bonded to one side of the sheet-like member 8. The water-soluble sheet-like member 8 is composed, for instance, of 30 to 50% of pulp fibers, 35 to 45% of polypropyrene fibers and 10 to 30% of powdery or fibrous polyvinyl alcohol. The mosquito net material 11 is, for instance, comprises vinilon No. 30 10-fiber warps 9 and stable fiber 6-fiber/inch weft yarns 10 and has a mesh size of 2 to 8 mm. When producing the sheet-like member 8, the mosquito net material 11 is bonded with polyvinyl alcohol as the material of the sheet-like member 8, thus imparting the front sheet 1 with a partial dissolution character to dissolve only the sheet-like material 8.

The back sheet 2 is a water-soluble sheet composed of 30 to 50% of pulp fibers, 35 to 40% of polypropyrene fibers, and 10 to 30% of powdery or fibrous polyvinyl alcohol.

If the proportion of fibers that are incorporated in either of the sheet-like member 8 of the front sheet 1 and the wholely water-soluble back sheet 2 is 30% or below, problems concerning the dispersion and mechanical strength are posed by the dissolution of polyvinyl alcohol by water absorption. If the proportion is 50% or above, on the other hand, problems concerning dissolution and mechanical strength due to water content are posed due to less proportions of the polypropyrene fibers or polyvinyl alcohol.

Further, where the proportion of polypropyrene fibers incorporated is 35% or below, problems concerning the dissolution and mechanical strength due to water content are posed. If the proportion is 45% or above, problems concerning the dissolution are posed due to reduction of the proportion of the pulp fibers and polyvinyl alcohol.

Further, if the proportion of polyvinyl alcohol is 10% or below, problems concerning the dissolution due to water content are posed. If the proportion is 30% or above, problems concerning the mechanical strength are posed due to reduction of the proportion of pulp fibers and polypropyrene fibers.

For the above reasons, the pulp fibers, polypropyrene fibers and polyvinyl alcohol are mixed in the above proportions to ensure the solubility and a predetermined mechanical strength.

However, the above proportions are by no means limitative. Most preferably, as the pump fibers are used those of conifers, as the polypropyrene fibers are used those with a thickness of 2 deniers and a length of 5 mm, as the polyvinyl alcohol are used fibers with a thickness of one denier and a length of 3 mm, and the sheet-like member 8 and back sheet 2 are obtained with 40% of the pulp fibers, 40% of polypropyrene fibers and 20 to 30% of polyvinyl alcohol.

Figure 4:
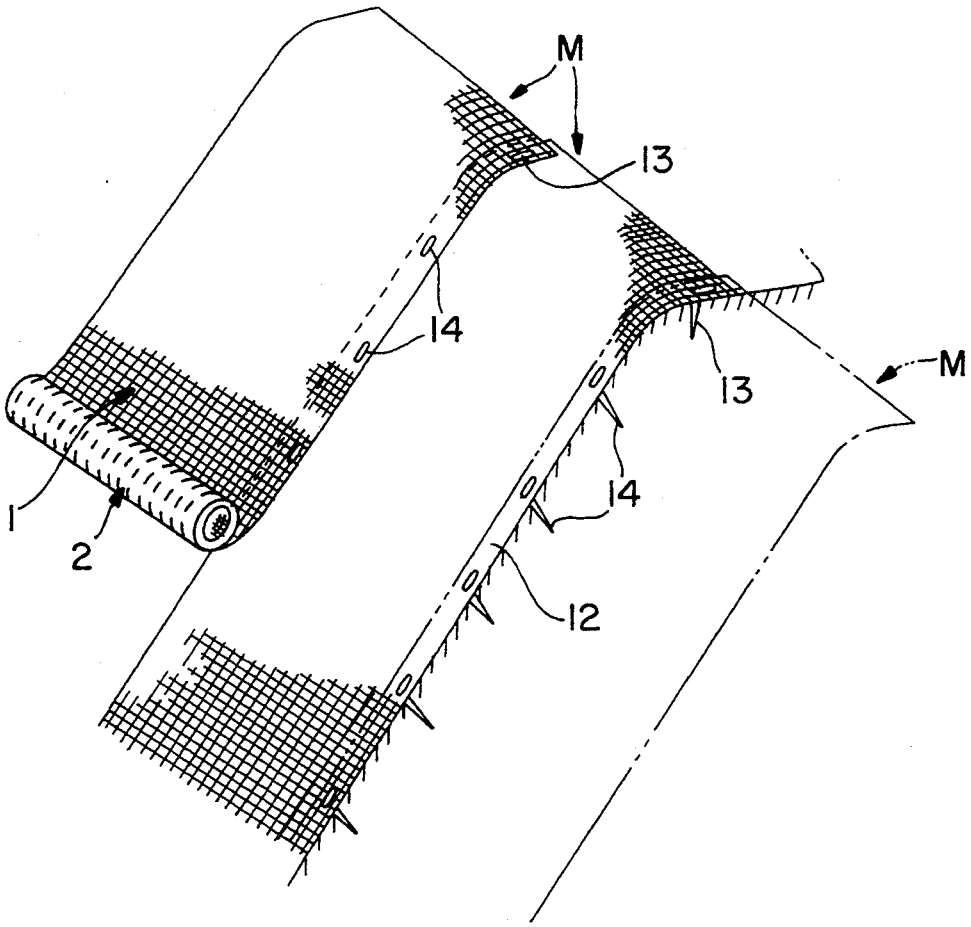
FIG. 4 is a view for explaining the provision of vegetation mats for making a green clad surface.

When making the clad surface green, as shown in FIG. 4, a plurality of vegetation mats M having the above structure are laid on a clad surface 12 side by side in their width direction such that their longitudinal direction is the vertical direction of the clad surface and that adjacent ones of them partly overlap each other in the width direction. Their overlapped portions are secured to the clad surface 12 by suitably driving anchors 13 and setting nails 14.

Where the vegetation mats M used are of the structure as shown in FIG. 1, their front and back surfaces are constituted by thin sheets, and their entirety is flexible very much. Thus, they can be satisfactorily familiar to the clad surface 12. Where the vegetation mats M are of the structure as shown in FIG. 2, the vegetation material 7 can be crumbled by slight force applied thereto. Thus, the vegetation mats M again can be satisfactorily familiar to the clad surface 12 and can be held in close contact with the clad surface 12 in a state that their partial spacing-apart is held suppressed.

Further, in the initial stage after the vegetation mat M has been laid on the clad surface 12, the vegetation material 7 is covered by the front and back sheets 1 and 2, and thus the flow-away of the vegetation material 7 can be effectively prevented.

Further, with rainfall the sheet-like member 8 of the front sheet 1 and polyvinyl alcohol of the back sheet 2 are quickly separated, bringing the pulp fibers and Polypropyrene fibers into a dispersed state. Thus, the most part of the back surface of the vegetation material 7 is held in close contact with the clad surface 12 without any clearance relative thereto. The vegetation seeds that are contained in the vegetation material 7 thus readily bud, and the seedling thus produced reliably grow with fertilizer and water supplied to it.

Meanwhile, in this embodiment the front sheet 1 of the vegetation mat M is capable of partial dissolution such that the mosquito net material 11 remains when the sheet-like member 8 is dissolved. The vegetation material 7 thus can be held satisfactorily by the mosquito net material 11 and the net 6 provided on the front surface of the front sheet 1. The net 6 thus can effectively prevent the freezing or flow-away of the vegetation material 7 without need of any operation of stretching a separate net.

The polyvinyl alcohol that is used may be powdery in form. Powdery polyvinyl alcohol can be dissolved at normal temperature, and this it can enhance the solubility of the sheet in water at normal temperature.

The structures of the vegetation mat M described above are only examples. For example, the back sheet 2 may be capable of partial dissolution like the front sheet 1. Also, it is possible to adopt a water-soluble film made of polyvinyl alcohol, non-woven stable fiber cloth having a dispersing character, and a sheet capable of partial dispersion which is obtainable by laminating the water-soluble film or dispersible non-woven cloth with the mosquito net material noted above.

Further, the front sheet 1 may be a water-soluble sheet like the back sheet 2, or it may be the above water-soluble film, dispersing non-woven cloth or a sheet capable of partial dispersion obtainable by laminating the mosquito net material with the above cloth or sheet.

Figure 5:
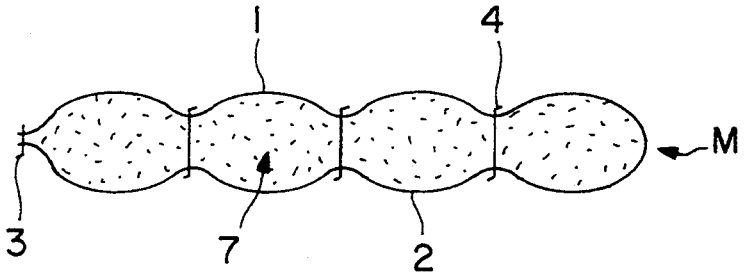
FIG. 5 is a sectional view showing a further embodiment of the vegetation mat.

As for the water solubility, dispersion, decomposition, etc., the front and back sheets 1 and 2 may be of any character so long as they are capable of partial decomposition.

Where the front and back sheets 1 and 2 are of the same character as in FIG. 5, instead of using the separate front and back sheets, a single wide sheet may be used by folding it along its center in the width direction. The free edges of the folded portions 1 and 2 are sewed together, as shown at 3, and also the folded portions 1 and 2 are sewed at a predetermined interval in the width direction, as shown at 4. In this way, the vegetation mat M is formed containing vegetation material 7. Further, instead of sewing, the two sheets 1 and 2 may be coupled together by thermal fusion, for instance.

Figure 6A:
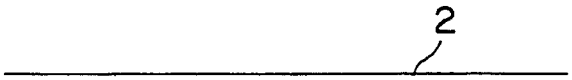
FIGS. 6(A) to 6(F) are views showing steps of a method of manufacturing a vegetation mat according to the invention.
Figure 6B:
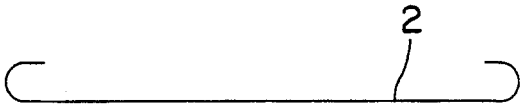
Figure 6C:
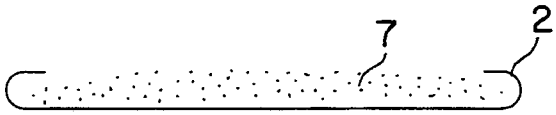
Figure 6D:
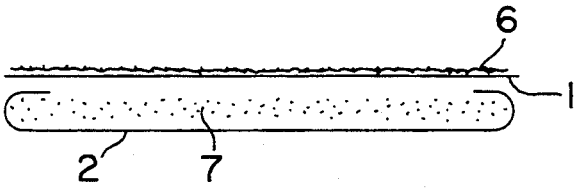
Figure 6E:
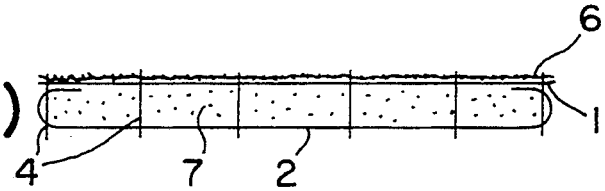
Figure 6F:
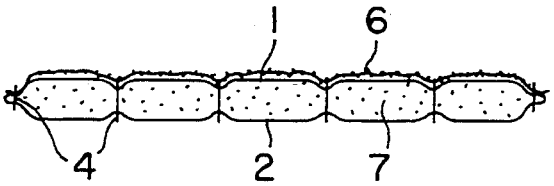

Further, it is possible to produce the vegetation mat M according to the invention in a process as shown in FIGS. 6(A) to 6(F). As shown in FIG. 6(A), the back sheet 2 is fed to a conveyor. Then, as shown in FIG. 6(B), opposite end portions of the back sheet 2 are bent by guides (not shown). Then, as shown in FIG. 6(C), the vegetation material 7 is supplied to the top of the back sheet 2. Then, as shown in FIG. 6(D), the top of the vegetation material 7 is covered with the front sheet 1, and then the net is set on the top of the front sheet 1. Then, as shown in FIG. 6(E), the net 6 and front and back sheets i and 2 are sewed at a coarse interval, as shown at 4. The opposite ends of this eventual vegetation mat M in the longitudinal direction thereof (i.e., direction perpendicular to the plane of the Figure), are suitably sewed together at a small interval, thus completing the vegetation mat M.

While the above net 6 is made of plant fibers, it is also suitable to use synthetic resin fibers such as polyethylene, viscous Rayon, biologically decomposable resin fibers and further strong Rayon, e.g., polynodic Rayon or viscous Rayon for tire cords.

The strong Rayon noted above, has high tensile strength and is subject to less strength reduction when it is swollen. Further, after the lapse of a half year from the installation, it can provide about 90% of the initial tensile strength. With subsequent lapse of time, it becomes the same as the earth in character through corrosion. By using this strong Rayon as the material of the net, it is possible to maintain sufficient mechanical strength for a half year to about two years, by which time the budding and growth of the plant will be obtained. Thus, the freezing and flow-away of the vegetation material 7 on the clad surface can be effectively prevented. By the time when the plant has grown to a certain extent and is going to throng, the net material is gradually decomposed and corroded to eventually become earth. It is thus possible to eliminate the secondary pollution problems that may be presented in case where the net material is synthetic resin fibers which are substantially permanently incapable of denaturing. Thus, this material is very suitable for making the green clad surface.

Further, corrosive fibers permit the material strength to be maintained for a half year to about two years if they are provided with corrosion-proof treatment. In this case, they are ultimately decomposed and corroded to become earth. Thus, this material is also suited as the net material.

The corrosion-proof treatment on the corrosive fibers, is usually one, in which the surface is made repulsive to water using an agent for making repulsive to water or an adhesive. However, since the decomposition and corrosion of the corrosive fibers take place in the presence of bacteria, a process is suitable, in which a net made of corrosive fibers or formed by braiding the corrosive fibers is immersed in or coated with a rust-proof agent, a bacteria-proof agent, a corrosion-proof agent, etc.

The corrosive material as the subject of the process of making repulsive to water, may be various materials such as animal, plant and chemical materials. Typical animal materials are leather and fur. Typical plant materials are such natural fibers as cotton, linen and pulp. Typical chemical materials are those of polyolefin type having been made readily corrosive with chemicals, viscous Rayon and like regenerated fibers, plastics capable of being decomposed by micro-creatures and optically decomposable plastics.

Synthetic resins which can not be decomposed, may be used to obtain pollution-free nets by blending them with corrosive fibers.

With the blend fibers composed of synthetic fibers and corrosive fibers, the synthetic fibers are neither decomposed nor corroded. However, by the time when the vegetation seeds have budded and are growing, the corrosive fibers are decomposed and corroded by micro-creatures to be the same as the soil. Thus, the entire net does not remain substantially permanently on the clad surface. Thus, the pollution problems are eliminated, and the blend fibers thus can be suitably used as the net material.

As the corrosive fibers of the blend fibers may be selected natural fibers which are decomposed and corroded by micro-creatures with the lapse of time, such as cotton, silk and linen, and also viscous Rayon and like biologically decomposable chemical fibers. As the synthetic fibers may be selected those which are not decomposed by micro-creatures but can substantially permanently ensure a predetermined tensile strength, such as vinylon type, e.g., polyvinyl alcohol, polyester type, e.g., polyester, polyamide type, e.g., nylon, and polyacrylonitrile type, e.g., acrylic acid. Their composition is suitably 60 to 80% of corrosive fibers and 40 to 20% of synthetic fibers.

Further, it is possible to use blend Rayon obtained by adding polymer emulsion and/or water-soluble polymer to a viscous solution to obtain nets, which are free from pollution problems and suitable for making green clad surfaces.

The emulsion or polymer that is added to the viscous solution is difficult to be corroded by micro-creatures but is decomposed with the corrosion of the blend Rayon. Thus, the net does not remain substantially permanently on the clad surface. Thus, it is free from pollution problems and permits the green clad surface to be attained.

As the blend Rayon may be used what is obtained by adding a polymer emulsion which can neither be decomposed nor corroded by micro-creatures and can make up for the strength reduction due to the decomposition and corrosion of Rayon (for instance, vinyl acetate resin, acrylic acid resin, ethylene acetate vinyl resin, etc.) or water-soluble polymer (for instance, polyvinyl alcohol, polyacrylamide, etc.) in a stage of viscous solution to a viscous solution composed of regenerated cellulose which is capable of being decomposed and corroded by micro-creatures, and also what is obtained by adding both emulsion and polymer.

The blend Rayon suitably has a composition obtained by adding 2 to 15% of polymer emulsion and/or water-soluble polymer to the viscous solution.

Further, the net 6 may be made of a corrosive material provided with a bacteria-proof treatment. For example, as the corrosive material may be used viscous Rayon fibers, and as the bacteria-proof agent for the bacteria-proof treatment may be used lauryldimethylbendylammonium chloride (e.g., "Meilapit V-43", a trade name by Meisei Kagaku Kogyo Co., Ltd.) or octadecyldimethylbendylammonium chloride (e.g., "Meikabinon SMB-85", a trade name by Meisei Kagaku Kogyo Co., Ltd.). Of these products, the effective component is dimethylbendylammonium chloride.

The sewing yarn for the sewing noted above may be selected from among the various net materials noted above.

AS the vegetation seeds to be mixed with the vegetation material 7 may be suitably selected those of foreign plants such as grass, those of flowers and those of local plants such as wild grass and trees.

Specifically, grass seeds may be those of *Festuca ruber, L.* sub-species, genuina vars, *Agrostis tenuis* and *Cynodon dactylon.* Flower seeds may be those of Chrysanthemum leucanthemum L, and *Dianthus, chisonsis L.* Wild grass seeds may be those of *Lespedeza cuneata G. Doh* and *Reynoutria japonica Houtt.*

Tree seeds are those of *Pinus densiflora Sieb. et Zucc.,* and *Lespedeza bicolor Turcz.*

As has been described in the foregoing, the vegetation mat according to the invention becomes satisfactorily familiar to the clad surface, and its back sheet can be at least partly decomposed to improve the familiarity the vegetation material to the clad surface. It is thus possible to lay vegetation mat on the clad surface without producing any parial spacing-apart but in stable close contact with the clad surface.

Besides, since the net is provided on the front surface of the vegetation mat, even when front sheet is partly or entirely decomposed, the freezing or flow-away of the vegetation material can be effectively prevented without need of any operation of stretching a separate net. Thus, it is possible to permit the budding and growth of the vegetation seeds to be attained satisfactorily. It is thus made possible to provide a vegetation mat, which can be suitably used for making green and protecting the clad surface and maintaining satisfactory scenery.

What is claimed is:

1. A vegetation mat comprising:

a layer of vegetation material selected from the group consisting of soil improvement material, fertilizer, organic material, vegetation seeds and combinations thereof, a front sheet and a water soluble back sheet, both capable of being at least partly decomposed, said sheets sandwiching said layer of vegetation material therebetween.

a net provided on the front surface of said front sheet having a mesh size permitting the budding and growth of the vegetation seeds through the mesh, wherein the opposite end portions of the water soluble back sheet is bent and coupled together to the front sheet and net to wrap the vegetation material.

2. The vegetation mat according to claim 1, wherein said front and back sheets are sewed together at predetermined intervals width-wise and at the edges of the sheets, with the exception of edges on one side in the length-wise direction to form pockets sections between the front and back sheets which are filled with vegetation material upon which the edges on the unsewed side is sewed to enclose the vegetation material.

3. The vegetation mat according to claim 1, wherein said front and back sheets are both water soluble and made from the same materials.

4. The vegetation mat according to claim 1, wherein said front sheet includes a water-soluble sheet-like member and a mosquito net material bonded to one side of said water-soluble member, said water-soluble sheet-like member being composed of 30 to 50% of pulp fibers, 35 to 45% of polypropyrene fibers and 10 to 30% of powdery or fibrous polyvinyl alcohol, said mosquito net material including vinylon warps and stable fiber weft yarns.

5. The vegetation mat according to claim 1, wherein said back sheet is a water-soluble sheet composed of 30 to 50% of pulp fibers, 35 to 45% of polypropyrene fibers, and 10 to 30% of powdery or fibrous polyvinyl alcohol.

6. The vegetation mat according to claim 1, wherein said front and back sheets have edges thereof sewed together at a small interval and are also sewed at a coarse interval in the length direction and at a predetermined interval in the width direction, thus forming a bag body with a restricted interval between said front and back sheets.

7. The vegetation mat according to claim 1, wherein said net is made of a biodegradable material provided with a bacteria-proof treatment.

8. The vegetation mat according to claim 1, wherein said net is made of a plant material selected from the group consisting of jute yarn, cotton yarn, paper tape and Rayon type yarn.

9. The vegetation mat according to claim 1, wherein said front and back sheets are constituted by a single wide sheet, a side sheet being folded at the center in the width direction, the folded portions of said wide sheet having free edges thereof sewed together.

10. The vegetation mat according to claim 1, wherein said front and back sheets are thermally fused together.

11. The vegetation mat according to claim 1, wherein at least one of said partly decomposable sheets is formed by subjecting corrosive fibers to a corrosion-proof treatment.

* * * * *